United States Patent [19]

Huck et al.

[11] 4,406,025

[45] Sep. 27, 1983

[54] BIDET APPARATUS FOR USE IN CONNECTION WITH A CONVENTIONAL FLUSH TOILET

[76] Inventors: Lewis F. Huck; James J. Huck, 15127 Kimberley Lane, both of Houston, Tex. 77079

[21] Appl. No.: 204,518

[22] Filed: Nov. 6, 1980

[51] Int. Cl.[3] ..... A61H 35/00; A47K 3/22

[52] U.S. Cl. ..... 4/443; 4/448; 4/420.2; 4/420.4

[58] Field of Search ..... 4/420.2, 420.4, 420.3, 4/443, 444, 447, 448, 446, 445

[56] References Cited

U.S. PATENT DOCUMENTS

| | | | |
|---|---|---|---|
| 1,346,252 | 7/1920 | Rathbone | 4/447 |
| 1,988,078 | 1/1935 | Guidetti | 4/448 |
| 3,247,524 | 4/1966 | Umann | 4/447 X |
| 3,513,487 | 5/1970 | Palermo et al. | 4/420.4 |
| 3,605,124 | 9/1971 | Marcard et al. | 4/420.2 |
| 3,947,899 | 4/1976 | Robinson et al. | 4/420.2 X |
| 4,028,745 | 6/1977 | Caniglia | 4/420.2 |
| 4,068,325 | 1/1978 | Benthin | 4/420.4 |
| 4,069,519 | 1/1978 | Alexander | 4/447 |
| 4,135,255 | 1/1979 | Menendez | 4/448 |
| 4,197,594 | 4/1980 | Butterfield | 4/448 |

*Primary Examiner*—Henry K. Artis

*Attorney, Agent, or Firm*—Irons & Sears

[57] ABSTRACT

A bidet attachment for use with a conventional flush toilet comprises a bidet tube having a bent handle portion at one end, an arcuate spray arm portion and attached spray nozzle at the opposite end, and an intermediate straight portion, together with a bidet tube support assembly which attaches to the underside of the toilet seat and permits the spray arm to be pivoted independently about first and second perpendicular axes. A warm water supply unit for use in connection with said bidet attachment includes an elongated vertical water storage vessel having a bottom inflow connection and a top outflow connection, a heater for the water in the vessel, a cold water supply line to the inflow connection, a water control valve interposed in said cold water supply line, and a warm water supply line from the vessel outflow connection to the bidet attachment.

4 Claims, 10 Drawing Figures

BIDET APPARATUS FOR USE IN CONNECTION WITH A CONVENTIONAL FLUSH TOILET

BACKGROUND OF THE INVENTION

1. Field of the Invention

The present invention relates generally to bidet devices for cleansing the anal and genital areas of the human body, and is particularly concerned with a bidet attachment and self-contained warm water supply unit for use in conjunction with a conventional flush toilet.

2. Description of the Prior Art

Hygienic cleansing devices for washing the anal and genital regions of the human body are well known and are an accepted part of ordinary personal hygiene in many parts of the world. These devices, commonly known as bidets, typically take the form of a freestanding bathroom fixture, similar in size and general configuration to an ordinary flush toilet, with hot and cold water taps for producing a flow of water at a comfortable temperature for cleansing purposes. In some cases, nozzles or spray heads have been provided in order to direct the flow of water to the particular area of the body that is to be cleansed.

Notwithstanding their positive contribution to personal hygiene, however, bidet devices have failed to find widespread domestic acceptance in the United States and in other countries as well. Part of the reason for this has to do with the physical size of most freestanding bidet units, which renders them undesirable in homes and apartments where floor space is at a premium. Then, too, the bidet unit represents an additional expense which builders and buyers of new homes or apartments may not be willing to undertake, particularly when the cost of making additional permanent plumbing connections is considered.

In an effort to offer the hygienic benefits of a bidet without the inconvenience and expense involved in the installation of a freestanding bidet unit, several bidet attachments intended for use in connection with ordinary flush toilets have been proposed. Some of these devices include projecting spray arms which may be moved between retracted and operative positions from an attachment point on the underside of the toilet seat, so that the normal function of the flush toilet is not impaired when the bidet device is not in use. By and large, however, these devices are characterized by a rather restricted range of positional adjustment for the spray arm, which may render them unsuitable to the needs of certain users. On the other hand, bidet attachments that offer a useful range of positional adjustment tend to be characterized by an undue level of mechanical complexity, which may affect their reliability and preclude their economical manufacture and widespread acceptance.

In U.S. Pat. No. 4,069,519, for example, a bidet attachment is disclosed which includes a circular mounting disc that is secured directly by means of a pair of screws to the bottom of a conventional tiolet seat. The mounting disc in turn retains a ring-like body which includes a handle extension and an elongated spray nozzle arm that is hinged to the ring-like body by means of an integral hinge. The mounting disc and spray nozzle arm are interconnected by means of an eccentric link, so that horizontal movement of the handle causes the spray nozzle arm to move in what is described as a "compound arc" between an elevated storage position beneath the back of the toilet seat and a lower operative position beneath the center of the seat opening. A spring-operated detent is provided to limit the movement of the handle and ring-like body within prescribed limits. Although this bidet attachment is, according to one of its stated objects, relatively simple in construction, its manner of operation inherently allows only one possible path of movement for the spray nozzle arm between the storage and use positions, which restricts its range of adjustment considerably.

U.S. Pat. No. 4,197,594 discloses a bidet attachment in which the bidet arm is rotatably connected to a supporting plate that is affixed by screws to the underside of the toilet seat. The configuration of the elongated bidet arm and its axis of rotation are said to be such that the spray head moves in a relatively shallow arc from a retracted position beneath the rear part of the toilet seat through an operative path beneath the seat opening. Again, however, the possible range of adjustment of this device is limited by the fact that only one path of movement is possible for the bidet arm and the spray head thereon.

U.S. Pat. No. 4,094,018 is illustrative of the rather elaborate mechanical arrangements which have sometimes been resorted to in order to provide bidet devices with a greater range of position adjustment. This patent describes a bidet device for a flush toilet in which two spray arms with intersecting jets are arranged to be brought into their operative positions by means of a common handle. The handle operates a rack-and-pinion device which causes the spray arms to swivel about a horizontal axis transverse to the toilet seat from their rest positions beneath the back of the toilet seat, and then to shift in a direction parallel to the seat to bring the spray nozzles into the desired operating position. The disclosed bidet device is installed by removing the existing toilet seat and replacing it with a specially-designed seat containing the necessary hardware.

Other examples of bidet attachments having pivoting or retracting spray arms may be found in U.S. Pat. Nos. 4,068,325, 1,346,252, 1,962,014, and 4,041,553, and in Japanese Pat. No. 52-25441, Italian Pat. No. 365,342, French Pat. No. 37,308 and Swiss Pat. No. 243,547.

Self-contained warm water supply units for bidet attachments may likewise be found in the prior art. See, for example, the disclosures of U.S. Pat. Nos. 3,947,899 and 4,192,023. A problem that has not been satisfactorily solved, however, is the maintenance of a uniform water temperature at the spray head during repeated uses of the bidet attachment. A closely related problem is the prevention of the abrupt and uncomfortable changes in water temperature that tend to occur when the warm water storage vessel in the supply unit is temporarily depleted. Neither of these problems can be adequately solved simply by increasing the amount of warm water available, since the capacity of the storage vessel will ordinarily be limited by practical constraints on the overall size of the warm water supply unit.

SUMMARY OF THE INVENTION

In accordance with the present invention, a bidet attachment for use in connection with a conventional flush toilet comprises a rigid bidet tube having a bent handle portion at one end thereof, an arcuate spray arm portion carrying a spray nozzle at the opposite end thereof, and an intermediate straight portion between the handle portion and the arcuate spray arm; and means attachable to the underside of a conventional toilet seat for supporting the intermediate straight portion of the bidet tube in a manner permitting the spray arm portion to be pivoted independently about a first axis common with the axis of the intermediate straight portion, and about a second axis which is perpendicular to the first axis and passes through the supporting means. The bidet tube and supporting means are positioned such that the spray arm portion of the bidet tube can be pivoted about the first axis from a storage position beneath the rear part of the toilet seat to a use position below the opening in the toilet seat.

In a preferred form of the invention, the supporting means comprises an outer ring which is arranged to be fixedly attached to the underside of the toilet seat, and an inner cylindrical disc having a flange portion on one end thereof and a lateral bore for rotatably receiving the intermediate straight portion of the bidet arm. The inner cylindrical disc is rotatably received within the outer ring in a manner such that the flange portion of the disc is retained between the outer ring and the underside of the toilet seat. The inner cylindrical disc is further provided with an axial bore communicating with the lateral bore for retaining a compressed spring between the intermediate portion of the bidet tube and the underside of the toilet seat. The compressed spring provides frictional resistance to the rotation of the spray arm about the first and second axes and thus performs a locking-in-place function for the spray arm.

Since the foregoing arrangement allows the spray arm of the bidet tube to be pivoted independently about two different axes, the position of the spray nozzle thereon is not confined to a single predetermined path and can be adjusted over a relatively wide area. Moreover, the hardware requirement for achieving this result is minimal, which renders the bidet attachement of the present invention inexpensive to manufacture and simple to install.

A further aspect of the present invention resides in the provision of an improved warm water supply unit for use in connection with a bidet attachment for a conventional flush toilet, wherein non-uniformities and sudden changes in the temperature of the water delivered to the bidet attachment are avoided. In particular, a warm water supply unit in accordance with the present invention comprises an elongated water storage vessel having an inflow connection at the bottom thereof and an outflow connection at the top thereof, means for heating the water in the vessel, a cold water supply line for supplying pressurized water to the inflow connection, a manual control valve interposed in the cold water supply line for controlling the flow of water to the inflow connection, and a warm water supply line connected to the outflow connection of the storage vessel for supplying warm water to the bidet attachment when the control valve is opened to admit pressurized cold water to the inflow connection of the storage vessel.

In a preferred form of the invention, the elongated storage vessel comprises a length of insulated metal pipe having a ratio of length to inside diameter of at least 15:1. A galvanized iron pipe having an outside diameter of about 2⅜ inches, a length of about 36 inches, and a wall thickness of about 3/16 inch, and an inside diameter of about 2 inches, has been found to be particularly effective when used as the main body of the storage vessel. Together with its end fittings, the iron pipe has an effective interior length of about 40 inches, for a ratio of length to inside diameter of about 20:1. In order to minimize the amount of cool water delivered to the bidet attachment at the start of each use, a portion of the warm water supply line to the bidet attachment preferably runs lengthwise along the exterior of the metal pipe within the supply unit and in contact therewith, so that heat is transmitted from the pipe to the water in the warm water supply line. The heating means for the vessel preferably comprises an electrical immersion heater which is controlled by a thermostat in response to the temperature of the water in the vessel.

BRIEF DESCRIPTION OF THE DRAWINGS

These and other objects, advantages and novel features of the present invention will be more readily apprehended from the following detailed description when read in conjunction with the appended drawings, in which.

Throughout the drawings, like reference numerals are used to refer to like parts.

DETAILED DESCRIPTION OF THE PREFERRED EMBODIMENT

Figure 1:
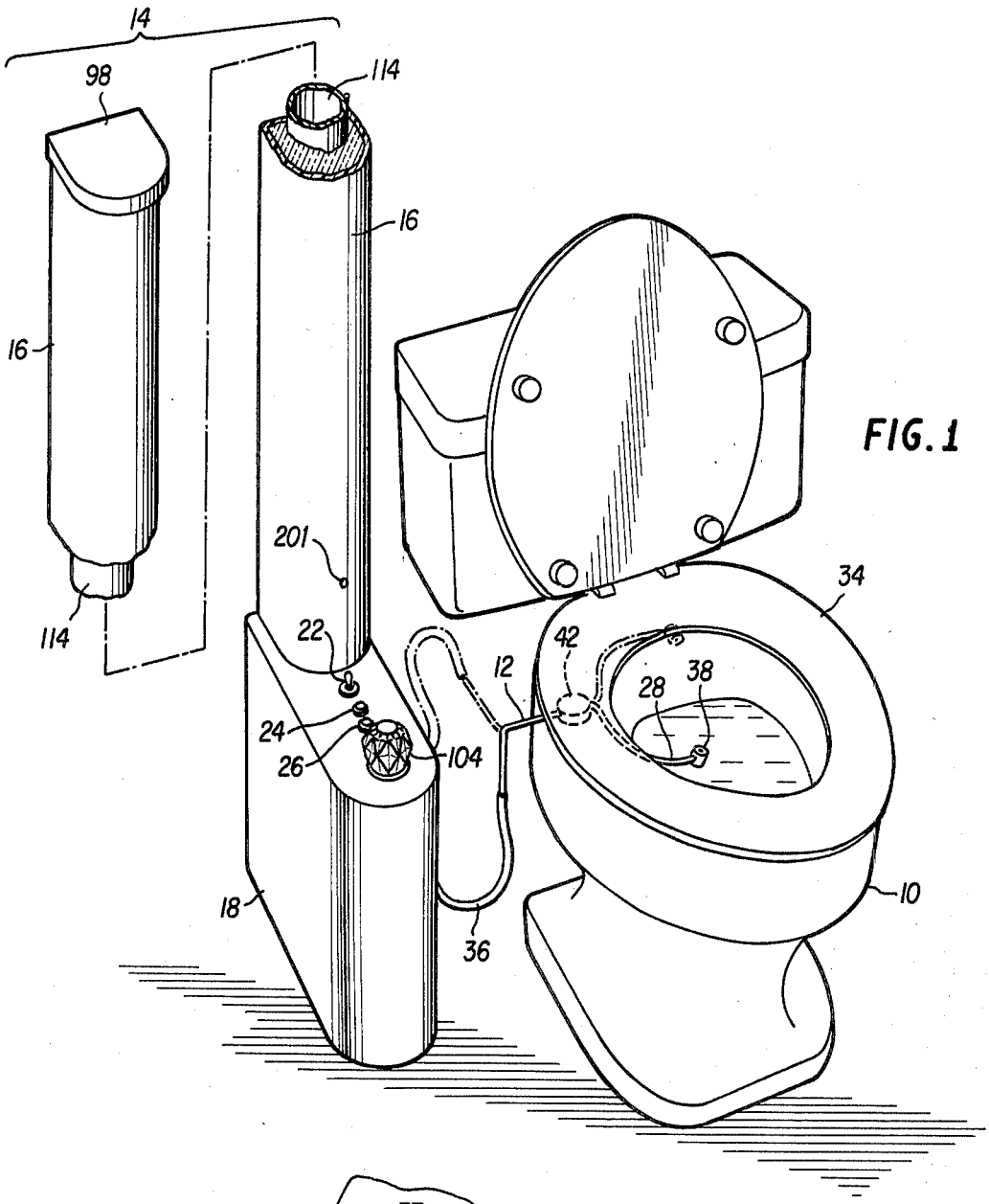
FIG. 1 is a front perspective view of a conventional flush toilet which has been equipped with a bidet attachment and self-contained warm water supply unit in accordance with the present invention.

With reference to the drawings, FIG. 1 is a front perspective view of a conventional flush toilet 10 which has been equipped with a bidet attachment 12 and a warm water supply unit 14 in accordance with the present invention.

The warm water supply unit 14 is provided with cold water from a standard plumbing connection, such as a commercially-available saddle valve, which may conveniently be installed in the existing cold water supply line to the water tank of the flush toilet 10. The water is heated to a selected temperature (typically 102° F.) by a thermostat-controlled electrical immersion heater and stored for later use in an insulated vessel 114 that is housed by the elongated upper portion 16 of the supply unit 14. The lower portion 18 of the supply unit is provided with a commercially-available water control valve 104 for controlling the supply of warm water to the bidet attachment 12 as well as the simultaneous refilling of the storage vessel from the cold water supply. A toggle switch 22 controls the supply of electrical power to the unit 14. Two indicator lights 24 and 26 are provided, the first indicating that the stored water temperature is within the normal operating range, and the other indicating that power is being supplied to the immersion heater in order to bring the water in the storage vessel up to operating temperature. The warm water supply unit as a whole is enclosed within a molded plastic, fiberglass or sheet metal housing as shown in order to provide a pleasing overall appearance.

Figure 2:
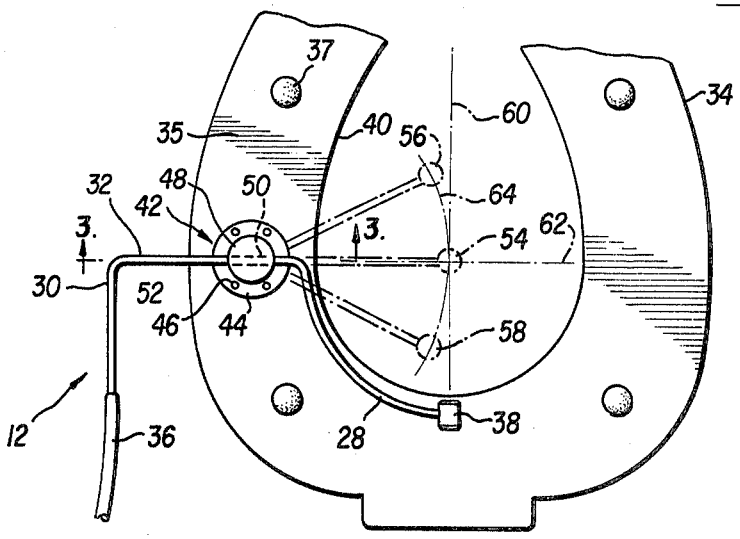
FIG. 2 is a bottom view of a conventional toilet seat which has been equipped with a bidet attachment in accordance with the present invention, illustrating the manner in which the position of the spray arm portion of the bidet tube may be adjusted by the user.

The bidet attachment 12 of FIG. 1 is more clearly illustrated in FIG. 2, in which the underside of the toilet seat 34 is shown with the bidet attachment 12 affixed thereto. The bidet attachment 12 comprises a continuous length of rigid hollow tubing (portions of which are indicated at 28, 30 and 32) forming a bidet tube, and an adjustable bidet tube support assembly 42 that is secured to the underside of the toilet seat 34. The bidet tube includes an arcuate portion 28 that serves as the spray arm, a bent handle portion 30 that facilitates manual adjustments in the position of the spray arm 28, and an intermediate straight portion 32 which passes through the adjustable support assembly 42 on the underside of the toilet seat 34 in a manner to be described hereinafter. The intermediate straight portion 32 of the bidet tube provides both mechanical and fluidic connection between the handle portion 30 and the arcuate spray arm 28 of the bidet tube. A length of flexible rubber or plastic tubing 36 is connected between the warm water supply unit 14 and the open end of the handle portion 30 to supply warm water to the bidet tube when the device is in use. The arcuate spray arm portion 28 of the bidet tube terminates in an externally threaded portion for receiving a suitable internally threaded sprinkler or spray head 38 of conventional design. The bidet tube, spray head 38 and adjustable support assembly 42 are all preferably made of stainless steel or some other suitable corrosion-resistant material.

In FIG. 1, the spray arm 28 is shown in solid outline in its operative or use position below the opening in the toilet seat 34. As will be explained in more detail shortly, however, the spray arm 28 may be pivoted, by appropriate manipulation of the handle 30, to a retracted or storage position in the area adjacent to the rear part of the toilet bowl rim on the underside of the toilet seat 34. The storage position is shown in phantom in FIG. 1. In this way, the seat opening is left entirely unobstructed when the bidet attachment is not being used, and the ability of the flush toilet 10 to be used in the normal manner is therefore not impaired.

With particular reference now to FIG. 2, the arcuate spray arm portion 28 of the bidet tube is shown in solid outline in its retracted or storage position on the underside of the seat 34, at a location just inside the edge of the seat opening 40. In accordance with an important aspect of the present invention, the arcuate spray arm portion 28 of the bidet tube can be pivoted independently about two different axes to bring the spray arm 28, together with the spray head 38 thereon, from its storage position to any one of an unlimited number of different operative positions (three of which have been indicated in phantom outline) below the seat opening 40, depending on the particular needs of the user. To this end, the adjustable bidet tube support assembly 42 comprises a fixed outer ring 44 that is secured by a number of screws 46 to the underside of the toilet seat 34, and a flanged inner cylindrical disc 48 that is retained within the fixed outer ring 44 in a manner such that the cylindrical disc 48 may be rotated in a plane parallel to the bottom surface of the toilet seat 34. Pads 37 project outward from the bottom surface 35 of the toilet seat 34 by a distance sufficient to provide clearance between the support assembly 42 and the rim of the toilet bowl when the seat 34 is in its lowered position as shown in FIG. 1. The inner cylindrical disc 48 of the support assembly includes a lateral hole or bore 50 (shown in phantom) for receiving the intermediate straight portion 32 of the bidet tube. The fit between the bore 50 and the straight portion 32 of the bidet tube is sufficiently loose to permit rotation of the bidet tube within the bore by clockwise or counterclockwise rotation of the handle portion 30. During initial assembly of the bidet attachment, the intermediate straight portion 32 of the bidet tube may be crimped to a slightly oval shape at a point 52 on the handle side of the bore 50, if desired, in order to prevent longitudinal movement of the bidet tube with respect to the cylindrical disc 48 while the bidet attachment is in use.

The foregoing arrangement allows the spray arm portion 28 of the bidet tube to be adjusted in two different ways by appropriate manipulation of the handle 30. First, by simply rotating the straight portion 32 of the bidet tube about its axis within the bore 50, the spray arm 28 may be moved from the storage position shown in solid outline through an arc of up to 180° toward the front portion of the toilet bowl, that is, toward the upper portion of the seat 34 in FIG. 2. Normally, the spray arm 28 will be rotated in this way from the storage position through an angle of approximately 90° to a position below the approximate center of the seat opening, as represented by the phantom position 54 in FIG. 2.

The second way in which the position of the spray arm 28 may be adjusted is by causing the inner cylindrical disc 48 of the support assembly 42 to rotate with respect to the fixed outer ring 44 in a plane parallel to the plane of the seat bottom 35, thereby causing the spray arm 28 to pivot about a vertical axis passing through the center of the inner cylindrical disc 48. This may be accomplished by grasping the handle portion 30 of the bidet tube and moving it either forward or backward with respect to the toilet seat 34. Thus, for example, once the spray arm 28 has been brought to the central position 54 by rotation of the straight portion 32 of the bidet tube within the bore 50, the spray arm may be further pivoted to one of the two off-center positions 56 or 58 (shown in phantom) by rotation of the inner cylindrical disc 48 with respect to the fixed outer ring 44 in the manner described above.

The manner in which the two adjustments described above cooperate to provide a useful range of position adjustment for the spray head 38 will now be apparent. The first adjustment, effected by the rotation of the straight portion 32 of the bidet tube within the bore 50, moves the spray head 38 forward or backward in an arcuate path below the longitudinal centerline 60 of the opening in the toilet seat 34. If this were the only adjustment provided, however, movement of the spray head 38 toward the front or back of the toilet bowl would necessarily be accompanied by a change in the angle of the water jet produced by the spray head, which may be undesirable in some instances. This limitation is avoided by virtue of the second adjustment, which is implemented by rotation of the inner cylindrical disc 48 with respect to the fixed outer ring 44. This permits the spray head 38 to be moved either forward or backward in an arcuate path 64 centered at the axis of rotation of the inner cylindrical disc 48, with no change in the angle (measured from the vertical) of the water jet emanating from the spray head. Thus in FIG. 2, for example, the second adjustment may be used to move the spray head 38 from the approximately central position 54 (defined by the intersection of the longitudinal centerline 60 and transverse centerline 62 of the seat opening) to either of the off-center positions 56 or 58 along the arcuate path 64, while maintaining a vertical trajectory of the water jet from the spray head 38 at all times.

For relatively small adjustments of the spray head 38 along the arcuate path 64, the spray head will not deviate appreciably from the longitudinal centerline 60 of the toilet seat opening. Therefore the second adjustment functions, for all intents and purposes, as a simple forward or backward adjustment of the spray head 38. If desired, however, the crimp 52 in the straight portion 32 of the bidet tube may be omitted or moved farther out toward the handle 30, thereby allowing the bidet tube to be moved in an axial direction (i.e., to the right or left in FIG. 2) within the bore 50. This would allow the spray head 38 to be restored to a position directly below the longitudinal axis 60 of the seat opening after the second adjustment has been made. This modification may also be advantageous in terms of providing an even greater range of position adjustment for the spray head 38, since axial movement of the bidet tube within the bore 50 has the effect of displacing to the right or left the entire arcuate path 64 that is followed by the spray head 38 during the second adjustment.

It will be appreciated that, since the adjustments described above may be made independently of one another, the movement of the spray head 38 is not confined to a single predetermined path below the opening in the toilet seat 34. This lends a great deal of versatility to the bidet attachment, since the spray head may be moved over a wide area to any one of an unlimited number of different positions below the seat opening, depending on the particular needs of the user. Moreover, as will become readily apparent as the description proceeds, this result is achieved without resort to complicated mechanical arrangements or numerous special-purpose hardware components.

Figure 3A:
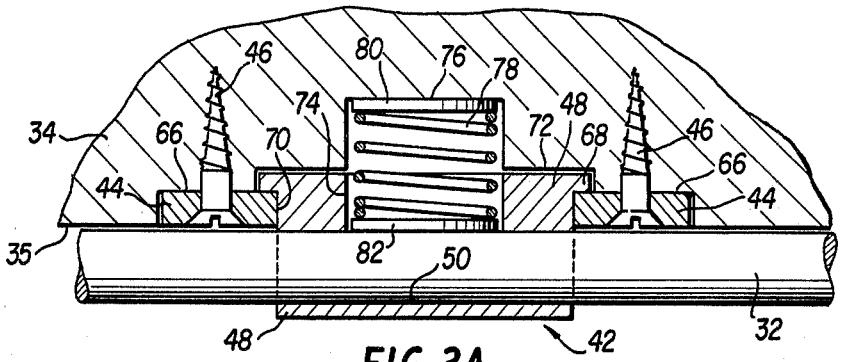
FIG. 3A is a partial sectional view of one embodiment of the adjustable bidet tube support assembly, taken along the line 3—3 in FIG. 2.
Figure 3B:
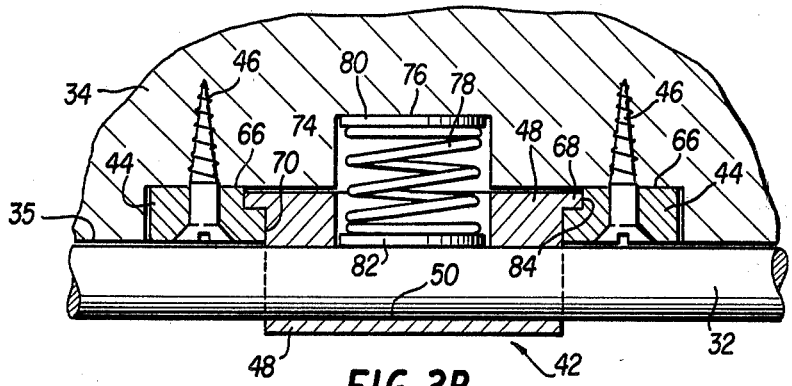
FIG. 3B is a partial sectional view of an alternative embodiment of the adjustable bidet tube support assembly, taken along the line 3—3 in FIG. 2.

Cross-sectional views of two different embodiments of the adjustable bidet tube support assembly 42 are illustrated in FIGS. 3A and 3B. The support assembly 42 performs three functions. First, it serves to attach the bidet tube as a whole to the underside of the toilet seat 34. Second, it permits the spray arm 28 to be moved out from its storage position and then adjusted as described previously to position the spray head 38 at the desired location below the seat opening 40. Finally, the support assembly 42 provides a locking-in-place function (in a manner to be described shortly) to maintain the spray arm 28 in the storage position or in one of the various possible use positions that may be selected by appropriate manipulation of the handle 30.

With particular reference now to FIG. 3A, the underside of the wood or plastic toilet seat 34 has been provided with a stepped circular cavity consisting of a set of concentric circular recesses of increasing depth in order to accommodate the bidet tube support assembly 42. The outermost and shallowest step 66 of the circular cavity is dimensioned for receiving the outer fixed ring 44 of the support assembly in a manner such that the surface of the outer ring 44 is flush with the bottom surface 35 of the toilet seat as shown. Flathead wood screws 46 pass through suitable holes in the outer ring 44, which in this case is a simple annulus with a rectangular cross-section, in order to affix the outer ring securely to the toilet seat 34. The inner cylindrical disc 48, which is formed with an annular flange portion 68 at its upper end, is rotatably received in the circular hole 70 formed by the fixed outer ring 44. The upper section of the inner cylindrical disc 48 is received by the next concentric step 72 of the circular recess, which is dimensioned to conform approximately to the thickness and diameter of the flange portion 68 of the inner cylindrical disc. The fixed outer ring 44 protrudes beyond the edge of the outermost step 66 of the cavity by a distance approximately equal to the projecting dimension of the flange 68, thereby forming a groove between the outer ring 44 and the middle step 72 of the recess for receiving and retaining the flange 68. This maintains the inner cylindrical disc 48 in place within the circular hole 70 in the fixed outer ring 44 of the support assembly. However, the fit between this groove and the flange 68, like the fit between the main body of the inner cylindrical disc 48 and the circular hole 70 formed by the fixed outer ring 44, is sufficiently loose to permit the disc 48 to rotate within the ring 44 in a plane parallel to the bottom surface 35 of the toilet seat 34. This permits the second of the two adjustments described earlier to be made.

With continued reference to FIG. 3A, the lower part of the inner cylindrical disc 48 is provided with a lateral bore 50 for receiving the straight portion 32 of the bidet tube. The fit between the bore 50 and the straight portion 32 of the bidet tube is sufficiently loose to permit rotation of the straight portion 32 of the bidet tube about its axis within the bore 50. An axial bore 74 communicates with the lateral bore 50 and extends upwardly to open onto the top surface of the inner cylindrical disc 48. The axial bore 74 aligns with the innermost circular recess 76 of the stepped cavity that has been formed in the bottom surface of the toilet seat 34. The axial bore 74 and innermost recess 76 are of approximately the same diameter and together form a cylindrical cavity for confining a compressed coil spring 78. A washer 80 is interposed between the top of the spring 78 and the top surface of the innermost recess 76. A similar washer 82 is interposed between the bottom of the spring 78 and the straight portion 32 of the bidet tube that is loosely received within the bore 50.

In accordance with an important feature of the present invention, the single compressed spring 78, acting through the washers 80 and 82, provides the locking-in-place function for all of the bidet tube adjustments described earlier. In particular, with reference to the first of the described adjustments, the downward force exerted by the spring 78 against the straight section 32 of the bidet tube creates enough friction to resist rotation of the bidet tube about its axis within the bore 50. This maintains the spray arm 28 (FIG. 2) in the storage position or in a selected use position, as the case may be. Due to the leverage created by the handle 30, however, the frictional resistance of the spring 78 is easily overcome when it is desired to move the spray arm from the storage position to the use position, or vice-versa. Since a part of the straight portion 32 of the bidet tube is confined within the walls of the bore 50, the downward force of the compressed spring 78 is also transmitted to the inner cylindrical disc 48 and in particular to the flange portion 68, which is therefore urged downwardly into frictional contact with the upper surface of the fixed outer ring 44 in the annular zone where the flange 68 and outer ring 44 overlap. This frictional contact tends to resist the rotation of the inner cylindrical disc 48 within the fixed outer ring 44, and thus provides the locking-in-place function for the second of the two adjustments described earlier. As before, however, the leverage available from the handle 30 (FIG. 2) allows the user to easily overcome the frictional resistance created by the spring 78 when it is desired to adjust the position of the spray arm 28 forward or backward by rotation of the inner cylindrical disc 48 with respect to the fixed outer disc 44.

In the case where the crimp 52 is omitted or moved farther out toward the handle 30 in order to allow the straight portion 32 of the bidet tube to be adjusted by axial movement through the bore 50, the upward pressure of the spring 78 against the bidet tube provides a frictional locking-in-place function for this adjustment as well.

FIG. 3B illustrates an alternative embodiment of the adjustable bidet tube support assembly 42. In most respects this embodiment is the same as that of FIG. 3A, except that the outer ring 44 has been provided with an integral annular groove or recess 84 for receiving the flange 68 of the inner cylindrical disc 48. This eliminates the need for the separate annular step 72 as shown in the toilet seat cavity of FIG. 3A, and thus eliminates some of the machining necessary to install the support assembly. The relationship of the outer ring 44 and inner cylindrical disc 48 of FIG. 3B is illustrated in the exploded perspective view of FIG. 4.

Figure 4:
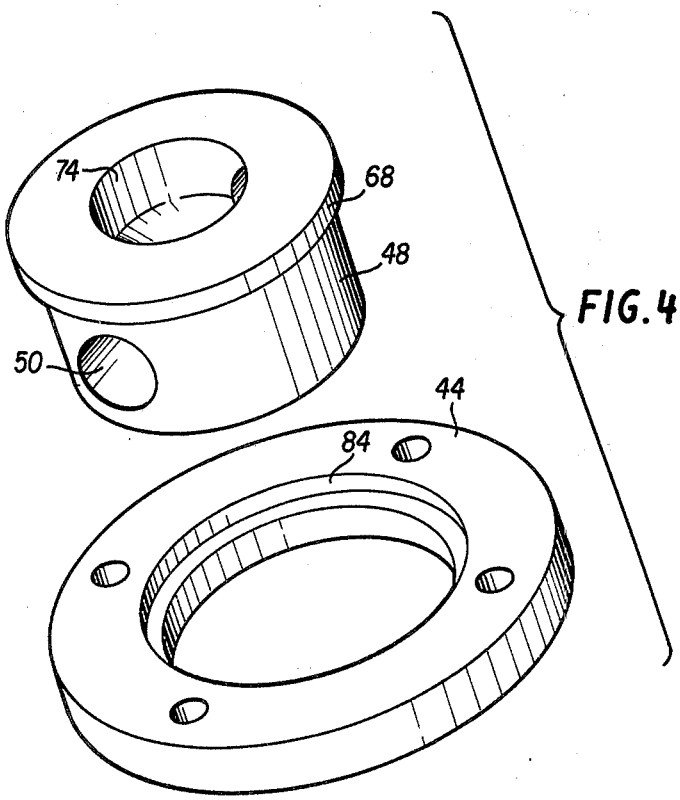
FIG. 4 is an exploded perspective view illustrating the relationship of the fixed outer retaining ring and the inner cylindrical disc of the adjustable bidet tube support assembly depicted in FIG. 3B.

In an exemplary embodiment of a bidet attachment 12 in accordance with FIGS. 1–4, the bidet tube comprises a length of $\frac{1}{4}$-inch (outside diameter) stainless steel tubing which is externally threaded at one end for receiving an internally threaded $\frac{5}{8}$-inch diameter spray head 38 of conventional design. A super bonding glue or metal solder may be used to supplement screw thread friction in order to secure the spray head onto the end of the bidet tube. The arcuate spray arm section 28 of the bidet tube subtends approximately 85° of circular arc at a radius of 4-17/32 inches. Alternatively, an appropriate noncircular configuration may be used for the arcuate section 28 in the event that a noncircular configuration is necessary to follow the contour of the toilet seat opening 40. The arcuate spray arm section 28 is followed by an 85° bend at a radius of $\frac{5}{8}$ inch, which is in turn followed by a $4\frac{1}{2}$ inch straight section 32. The straight section 32 terminates in a final 90° bend at a $\frac{5}{8}$-inch radius, which is followed by a $1\frac{5}{8}$ inch handle section 30. The final 90° bend for the handle is made after the straight portion 32 of the bidet tube has been slipped through the bore 50 in the inner cylindrical disc 48, which is in turn done after the outer ring 44 has been slipped over the inner cylindrical disc 48 and into contact with the flange portion 68. The handle section 30 of the bidet tube may be covered by a length of heat-shrinkable plastic tubing to increase its outside diameter slightly for a tight fit with the $\frac{3}{8}$-inch outside diameter ($\frac{1}{4}$-inch inside diameter) flexible plastic tubing 36 that carries warm water to the bidet attachment from the supply unit 14. In the embodiment of FIGS. 3B and 4, the main body of the inner cylindrical disc 48 of the adjustable bidet tube support assembly 42 is 0.425 inch in height and 0.960–0.964 inch in diameter, with the flange 68 bringing the overall diameter to 1.100 inches. The flange 68 is 1/16 inch in height. The lateral bore 50 is 0.2510 inch in diameter and has its axis 0.275 inch below the top (i.e., flange-end) surface of the disc 48. The axial bore 74 is 33/64 inch in diameter and is concentric with the cylindrical body of the disc 48. The outer ring 44 of FIGS. 3B and 4 is $1\frac{3}{4}$ inches in diameter, $\frac{1}{8}$ inch thick, and has a central hole 0.967–0.969 inch in diameter for receiving the main body of the inner cylindrical disc 48. The flange-receiving groove 84 is 1.120 inches in diameter and extends 1/16 inch inward from the top surface of the ring 44. Four screw holes for number 6 flat-head wood screws are countersunk in two 60°-spaced pairs on a radius of 11/16 inch from the center of the ring 44 (when the ring 44 is installed on the bottom of a conventional toilet seat, the screw holes are oriented so as to allow the screws to be sunk where the seat is thickest in cross-section, as shown in FIG. 2). Dimensions for the cylindrical disc 48 and outer ring 44 in the embodiment of FIG. 3A are generally similar, except that the disc 48 is made slightly taller (0.488 inch as opposed to 0.425 inch), and the axis of the lateral bore 50 located slightly farther below the top surface of the disc (0.338 inch as opposed to 0.275 inch), to compensate for the absence of the flange-receiving groove 84 of FIGS. 3B and 4 in the outer ring 44 of FIG. 3A. The washers 80 and 82 in FIGS. 3A and 3B are 0.049 inch thick and $\frac{1}{2}$ inch in outside diameter. The coil spring 78 measures 0.480 inch in outside diameter, 0.305 inch in solid height (i.e., fully compressed), and exerts 36 pounds of force in its fully compressed state. For the FIG. 3A embodiment, the stepped cavity that is bored into the underside of the toilet seat 34 for accommodating the support assembly 42 consists of concentric circular recesses measuring 1-13/16 inches, $1\frac{1}{8}$ inches, and 33/64 inch in diameter, and $\frac{1}{8}$ inch, 7/32 inch, and $\frac{3}{8}$ inch in depth, respectively. For the FIG. 3B embodiment, the cavity consists of only two concentric circular recesses, these measuring 1-13/16 inches and 33/64 inch in diameter, and $\frac{1}{8}$ inch and $\frac{3}{8}$ inch in depth, respectively. When the bidet tube support assembly 42 of either FIG. 3A or FIG. 3B is retrofitted to an existing toilet seat, the seat may have to be raised somewhat in order to provide clearance between the bottom surface of the inner cylindrical disc 48 and to the rim of the toilet bowl when the seat 34 is in its lowered position as shown in FIG. 1. This may be accomplished by the installation of spacers under the toilet seat bolts at the rear of the seat, and by the installation of a new set of toilet seat pads 37 on the underside of the toilet seat 34 in the event that the original pads are not high enough to provide the necessary amount of clearance. It is to be understood, however, that all of the foregoing details of construction are by way of example only, there being no intent to limit the bidet attachment of the present invention to any particular choice of dimensions, materials or method of construction.

Figure 5:
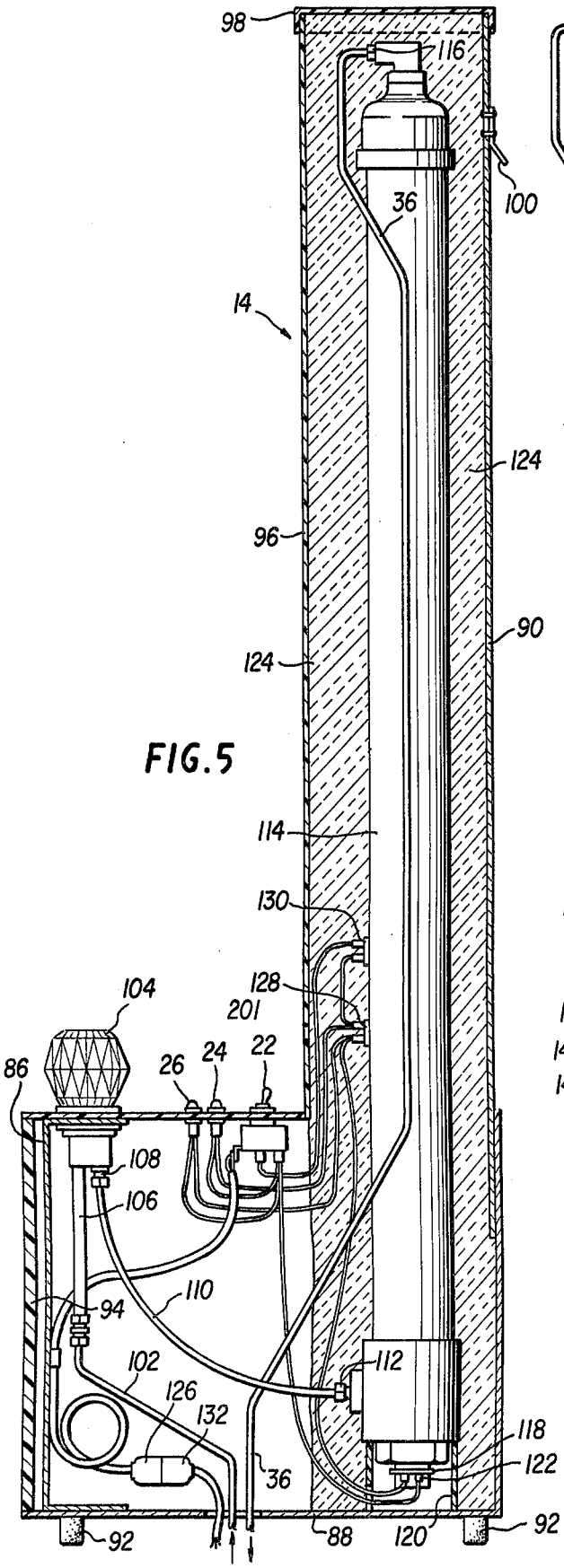
FIG. 5 is a cut-away side view of the warm water supply unit of FIG. 1, illustrating the internal components thereof.

FIG. 5 is a side elevational view of the warm water supply unit 14 of FIG. 1, illustrating the internal components thereof. Three interconnected frame members, preferably made of aluminum or some other rigid lightweight material and attached to one another by screws or rivets, provide structural rigidity. These include a U-shaped valve support frame 86, an L-shaped bottom and back frame 88, and a somewhat narrower back plate 90. If desired, the frame members 86, 88 and 90 may be replaced with a one-piece metal frame bent into the appropriate configuration. Three-quarter inch rubber mounts 92 are affixed to the bottom and back frame 88 at each corner of the unit in order to provide a stable footing for the unit and to provide ample clearance from possible accumulations of water on the floor below the unit. The internal components of the unit are enclosed by a generally U-shaped lower housing section 94, a narrower U-shaped upper housing section 96, and a top cap 98, all made of molded plastic or sheet metal to provide a smooth and attractive overall appearance. As an alternative to the coupled housing sections 94, 96 and 98, a one-piece molded plastic or fiberglass housing may be employed. A male bracket 100 is affixed to the upper part of the back plate 90, and is intended to mate with a corresponding female bracket (not shown) that is provided on the bathroom wall immediately behind the warm water supply unit in order to prevent the unit from being accidentally tipped over.

The warm water unit 14 is supplied with pressurized cold water through a length of ¼ inch (outside diameter) flexible rubber or plastic pressure tubing 102 that is connected by means of a conventional or self-piercing Kaddis ¼-inch saddle valve (not shown) to the existing cold water supply plumbing for the flush toilet 10 of FIG. 1. The saddle valve has three purposes. First, it supplies the cold water which is warmed by the supply unit 14 for use in the bidet attachment 12. In addition, when opened only partially, the saddle valve serves to limit the maximum water pressure that is available at the spray head 38 of the bidet attachment. Finally, when the saddle valve is completely closed it allows the warm water supply unit 14 to be disconnected or removed entirely without rendering the flush toilet 10 inoperable.

At the supply unit end, the flexible plastic tubing 102 is connected to the input side 106 of a conventional rotary-type water control valve 104 that is mounted in the valve support frame 86. The water control valve 104 is the main operating control for the warm water supply unit 14, functioning (when opened) to discharge warm water at the output of the unit for use in the bidet attachment 12 and to simultaneously refill the storage vessel of the supply unit with cold water to be heated. A suitable water control valve for this purpose is the Model 4258 unit, manufactured by Delta Faucet Company of Greensburg, Ind. The combination of the valve opening on the water control valve 104 and the valve opening on the saddle valve attached to the cold water supply line for the flush toilet 10, together with the existing pressure in the cold water supply line to the flush toilet, determines the pressure of the warm water discharged from the spray head 38 of the bidet attachment 12.

The output 108 of the water control valve 104 is connected to a further length of flexible rubber or plastic pressure tubing 110 for carrying cold water to an inflow connection 112 near the bottom of an elongated warm water storage vessel 114. As will be described in more detail hereinafter, the storage vessel 114 comprises a length of metal pipe that is closed at both ends except for the inflow connection 112 near the bottom of the vessel and a similar outflow connection 116 at the top of the vessel. A thermostatically-controlled electrical immersion heater 118 is installed in the bottom of the vessel for heating the water stored in the vessel to a temperature of approximately 102° F. or some other selected temperature. A short length of plastic pipe 120 is secured to the bottom and back frame 88 of the unit in order to support the vessel 114 and to provide sufficient clearance for making the necessary electrical connections to the terminals 122 of the immersion heater 118.

When cold water is introduced into the bottom of the vessel 114 by opening the water control valve 104, the warm water already stored in the vessel is pushed upward and discharged out of the outflow connection 116. The flexible warm water supply tubing 36 for the bidet attachment 12 (FIGS. 1 and 2) is connected to the outflow connection 116 and runs alongside the vessel 114 to an exit point at the bottom of the warm water supply unit 14. Preferably, as much as possible of the flexible tubing 36 is maintained in actual contact with the side of the metal vessel 114, as shown, in order to keep the water in the tubing 36 warm by virtue of the heat transmitted through the metal walls of the vessel 114. This reduces the effective length of "cold" tubing between the supply unit 14 and the bidet attachment 12 and thus reduces the amount of cool water that must pass through the spray head 38 of the bidet attachment 12 at the start of each successive use. As a result, the water delivered to the bidet attachment reaches a comfortable temperature in a shorter amount of time. Efficient contact between the tubing 36 and the side of the vessel 114 may be maintained by a number of clamps (not shown) or by a suitable adhesive.

Around the warm water storage vessel 114 is placed a two-piece styrofoam insulation wrapping 124 that is split down the front and back and substantially completely fills the space around the vessel 114 in the upper housing section 96 as well as in the rear part of the lower housing section 94. The styrofoam insulation wrapping 124 serves not only to reduce heat loss from the warm water storage vessel 114 and the adjacent warm water supply tubing 36, but also assists in holding the storage vessel 114 in place with respect to the upper housing section 96 of the unit, and in maintaining the flexible tubing 36 in lengthwise contact with the elongated storage vessel 114 as described earlier.

It will be observed that the water in the storage vessel 114 is pressurized only when the water control valve 104 is opened to admit cold water into the inflow connection 112 at the bottom of the vessel. This eliminates the need for a pressure release valve, which is ordinarily provided in continuously pressurized systems, and thereby reduces the cost involved in manufacturing the warm water supply unit 14.

The electrical components of the warm water supply unit 14 include a standard three-prong male electrical plug 126, a toggle switch 22, a pair of indicator lights 24 and 26, the electrical immersion heater 118, and primary and high-limit thermostats 128 and 130, respectively, for the warm water storage vessel 114. Suitable lengths of insulated electrical wiring are used to interconnect these components in the appropriate manner, as will be described shortly in connection with FIGS. 7A–7C. The electrical plug 126 is preferably retained within the lower housing section 94 of the unit, as shown, and connected by the user to the female end 132 of a standard extension cord prior to placing the unit into operation. This eliminates unnecessary lengths of electrical cord and eliminates a potential electrical shock hazard by confining the connection between the supply unit plug 126 and extension cord plug 132 to a location safely within the housing of the warm water supply unit 14. The plug 126 is accessible through a sufficiently large hole formed in the bottom and back frame 88. This hole also provides the entry and exit points for the two water lines 36 and 102. Toggle switch 22 is of the double-pole, single-throw type and controls the supply of electrical power to the immersion heating element 118 through the two thermostats 128 and 130. The primary thermostat 128 is adjustable (e.g., between 85° and 110° F.) to open at the desired water temperature that is to be provided by the unit. A suitable thermostat for this purpose is the Model 30000-48 surface mounting unit, manufactured by Fenwall Incorporated of Ashland, Mass., with catalog modifications 57, 58 and 62. This thermostat is rated at 10 amperes at 120 volts A.C. A small hole 201 will be provided in the upper housing section 96 at a point adjacent to the primary thermostat 128 in order to permit the temperature adjustment to be made by the user with a screwdriver or other suitable tool. The high-limit thermostat 130 is of the bimetallic snap-disc type and will disconnect the power from the immersion heater 118 when the water temperature reaches some predetermined limit, typically 110°±4° F. A suitable thermostat of this type is the Model 5004 unit, manufactured by Airpax/North American Philips Controls Corporation of Frederick, Md. (quick connect terminal configuration with oval mounting bracket), also rated at 10 amperes at 120 volts A.C. The thermostats 128 and 130 are both affixed to flattened areas on the external surface of the warm water storage vessel 114 in the conventional manner. The indicator light 24, which is preferably amber-colored, is illuminated whenever the toggle switch 22 is in the "on" position and the contacts of the high-limit thermostat 130 are closed. The other indicator light 26, which is preferably red, is illuminated when power is being supplied to the immersion heater 118 in order to bring the water in the storage vessel 114 up to operating temperature. The toggle switch 22 and the two indicator lights 24 and 26 are mounted in the upper panel of the lower housing section 94 as shown for convenient accessibility by the user.

Figure 6:
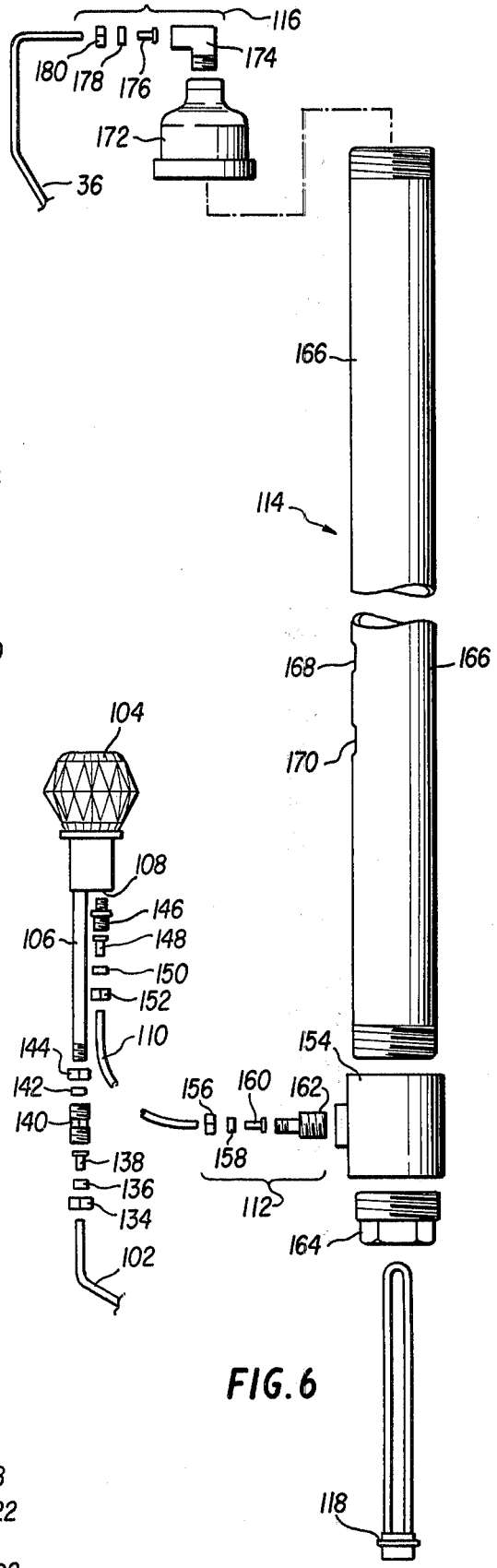
FIG. 6 is an exploded view of the warm water storage vessel and other plumbing components in the warm water supply unit of FIG. 5.

The warm water storage vessel 114 and other plumbing components of the warm water storage unit 14 of FIG. 5 are depicted in more detail in the exploded view of FIG. 6. The ¼ inch (outside diameter) flexible plastic tubing 102 from the cold water supply line is connected to the input 106 of the water control valve 104 by means of a brass compression nut 134, a plastic compression ferrule 136, a copper insert 138, a threaded brass fitting 140, a brass compression ferrule 142, and a further brass compression nut 144. The output 108 of the water control valve 104 is connected to a length of ¼ inch (outside diameter) flexible plastic tubing 110 by means of a threaded brass fitting 146, a copper insert 148, a plastic compression ferrule 150, and a further brass compression nut 152. At its opposite end, the flexible tubing 110 is connected to a galvanized iron pipe tee 154 by means of a brass compression nut 156, a plastic compression ferrule 158, a copper insert 160 and a threaded brass fitting 162, which together comprise the inflow connection 112 to the vessel 114. The lower end of the pipe tee 154 receives a threaded reducing bushing 164, which in turn receives the threaded base of a 750- or 1000-watt, 120-volt A.C. electrical immersion heater 118. The immersion heater 118 may be a Model D17S (750-watt) or D110S (1000-watt) unit, manufactured by Electro-Therm, Incorporated of Laurel, Md. The upper end of the pipe tee 154 is threadably engaged with the lower end of a 36-inch length of galvanized iron pipe 166 measuring 2⅜ inches in outside diameter and having a wall thickness of approximately 3/16 inch. The pipe section 116 forms the main body of the warm water storage vessel 114. Flattened areas approximately ½ inch wide are formed by filing on the side surface of the pipe section 166 at locations 170 (approximately 8 inches from the lower end of the pipe section) and 168 (approximately 14 inches from the lower end of the pipe section). The high-limit thermostat 130 (FIG. 5) is installed at the location 168, and the primary adjustable thermostat 128 is installed at the location 170. When the vessel is assembled, the generally U-shaped heating element of the immersion heater 118 passes through the bushing 164 and pipe tee 154, and extends into the lower portion of the galvanized iron pipe section 166. For the particular immersion heating units identified above, the total extension of the heating element into the pipe tee 154 and pipe section 166 is about 7¾ inches. At the upper threaded end of the pipe section 166, a threaded bell reducer 172 of galvanized iron is installed. The constricted opening of the bell reducer is connected to the warm water supply tubing 36 for the bidet attachment by means of a threaded brass elbow 174, a copper insert 176, a plastic compression ferrule 178, and a brass compression nut 180, which together comprise the outflow connection 116 of the vessel 114. For a pipe section 166 having the dimensions given above, with the pipe tee 154 and bell reducer 172 attached, the vessel 114 has an effective interior length of about 40 inches and a capacity of about 2.5 liters, which is ordinarily more than sufficient for a single use of the bidet attachment 12 of FIG. 1.

A number of important advantages result from the warm water supply vessel construction described above. In particular, the use of an elongated, insulated metal pipe section 166 as the main body of the vessel 114 helps to maintain a uniform temperature of the water throughout the vessel. This is due in part to the high conductivity and heat capacity of the metal walls of the vessel, and in part to the fact that the elongated cylindrical shape of the vessel maximizes the effective surface area of the vessel that is in contact with the stored water for a given volume of water. As a result, the water temperature is maintained fairly constant along the length of the pipe section vessel 114, so that the temperature of the water emerging from the spray nozzle of the bidet tube does not vary appreciably with time. Moreover, the heat stored by the heavy metal walls of the supply vessel tends to warm the incoming cold water somewhat, which produces a smooth rather than abrupt change in the outflow water temperature when the warm water previously stored in the vessel 114 is temporarily exhausted due to heavy or repeated uses of the bidet attachment.

A further important advantage of the elongated vessel construction of FIG. 6 is that it minimizes mixing between the cold water entering at the inflow connection and the warm water discharged at the outflow connection. This is due in part to the large distance separating the inflow and outflow connections, owing to the elongated shape of the vessel, and in part to the placement of the inflow connection at the bottom of the vessel (where the cold water will tend to remain) and the outflow connection at the top of the vessel (where the warm water will tend to accumulate). As a result, infiltration of the column of warm water in the upper portion of the vessel 114 by cold water entering at the bottom is minimized and a uniformly warm water temperature at the outflow connection of the vessel is assured. In addition, since any gases which collect in the vessel 114 will tend to accumulate in the top section thereof, placement of the outflow connection at the top of the vessel allows these gases to be purged from the vessel each time that the supply unit is used.

A length of iron pipe, galvanized inside and outside for corrosion resistance, has been found to be a particularly suitable material for the vessel 114 since iron conducts heat readily and is capable of retaining a relatively large amount of heat per unit volume. It will be apparent, however, that other materials with favorable heat conduction and heat retention characteristics, such as copper, may be used for the vessel 114 if desired. Thus, for example, a length of copper tubing having an outside diameter of $3\frac{1}{8}$ inches and an inside diameter of 3 inches may be substituted for the 2-inch inside diameter iron pipe section to provide a greater warm water storage capacity for the vessel 114.

Although the pipe section 166 should be as high and narrow as possible in order to maximize the effective internal surface area of the vessel for a given volume of stored water and to minimize mixing, the pipe section 116 is not restricted to the exemplary dimensions given earlier. Thus, for example, although the vessel in the preferred galvanized iron embodiment has an effective height-to-diameter ratio of about 20:1 (calculated from an effective interior length of about 40 inches and an inside diameter of about 2 inches), it is believed that the advantages described previously are substantially preserved for a height-to-diameter ratio of 15:1 or even less. It should also be appreciated that the cross-section of the vessel 114 need not be circular, as in the preferred embodiment, but may alternatively be oval, elliptical, square, rectangular, or any other desired shape. If desired, moreover, the elongated vessel 114 may assume a helical or serpentine configuration in order to obtain a greater effective length for the same overall vertical height.

Figure 7A:
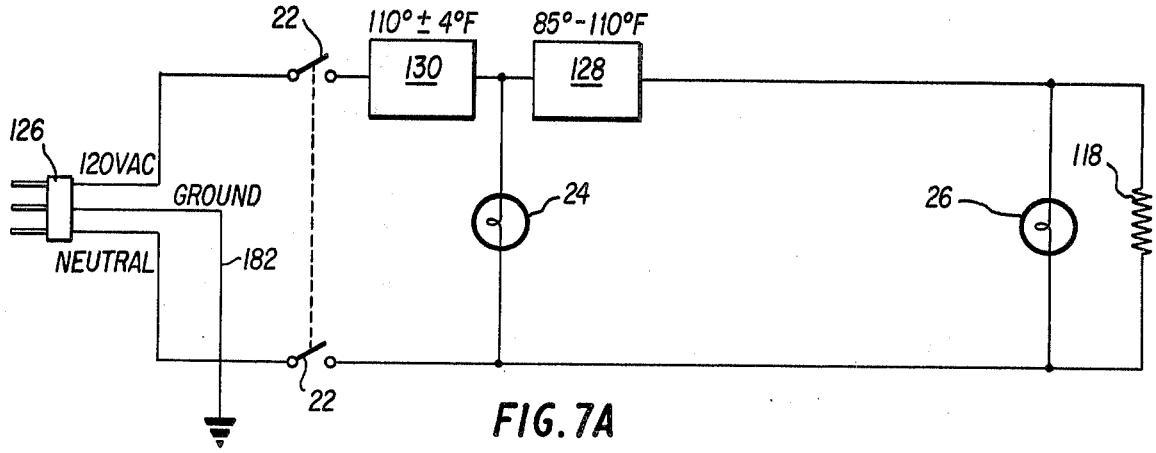
FIG. 7A is an electrical schematic diagram for the warm water supply unit of FIG. 5.

An electrical schematic diagram for the warm water supply unit 14 of FIG. 5 is illustrated in FIG. 7A. Both sides of the 120-volt A.C. supply line from the 3-prong plug 126 are switched by the double-pole, single-throw toggle switch 22, which is rated for 15 amperes at 120 volts A.C. The heating element of the 120-volt A.C. immersion heater 118, which is preferably rated for 750 or 1000 watts, is placed in series relationship with the primary adjustable thermostat 128 and high-limit thermostat 130 and will therefore receive power only when both thermostats are closed. As described previously, the primary adjustable thermostat 128 may be adjusted to open at any selected temperature within a typical range of 85°–100° F., and the high-limit thermostat is preferably preset to open at 110°±4° F. The red indicator light 26 is wired in parallel with the immersion heater 118 to indicate when the unit is in the process of heating the stored water up to operating temperature, and is intended to serve as a "not ready" light. The amber indicator light 24 is wired between the high limit thermostat 130 and the neutral side of the A.C. supply line as shown, and is illuminated when the toggle switch 22 and the contacts of the high-limit thermostat 130 are both closed. This indicates that the unit is "on" and that the preset high-limit temperature of the thermostat 130 has not been exceeded. The indicator lights 24 and 26 may be of the neon type or, if desired, of the incandescent type. The ground line 182 from the third prong of the plug 126 is connected to the metal warm water storage vessel 114 and to the frame components 86, 88 and 90 (FIG. 5) of the warm water supply unit in order to prevent an electrical shock hazard.

Figure 7B:
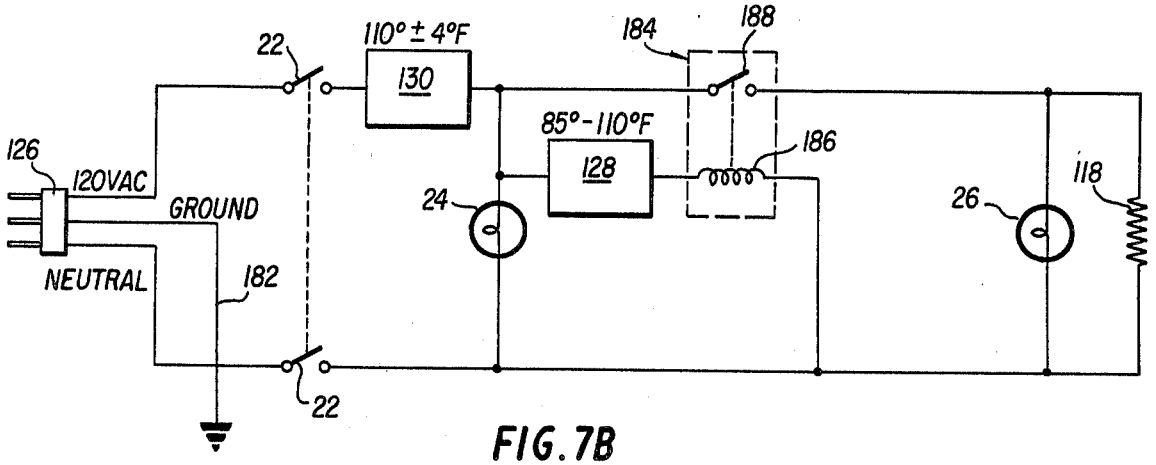
FIG. 7B is a modified electrical schematic diagram for the warm water supply unit of FIG. 5.

A slightly modified version of the electrical schematic diagram of FIG. 7A is illustrated in FIG. 7B. In this case, the thermostat 128 controls the current to the coil 186 of a normally-open A.C. relay 184 rather than the current to the immersion heater 118 directly. The current to the immersion heater 118 is controlled by the contacts 188 of the relay 184. In this way the thermostats 128 is not required to switch the rather large immersion heater current directly, thereby allowing a smaller, less expensive and more sensitive and reliable thermostat to be used. The red indicator light 26 is wired in parallel with the immersion heater 118 as in FIG. 7A. The amber indicator light is wired between the high-limit thermostat 130 and the neutral side of the A.C. supply line, also as in FIG. 7A. In the interest of reliability, the relay 184 may be of the solid state type, such as the Model A1210 unit manufactured by International Rectifier/Crydom Division of El Segundo, California, which is rated for 10 amperes at 100–140 volts A.C.

Figure 7C:
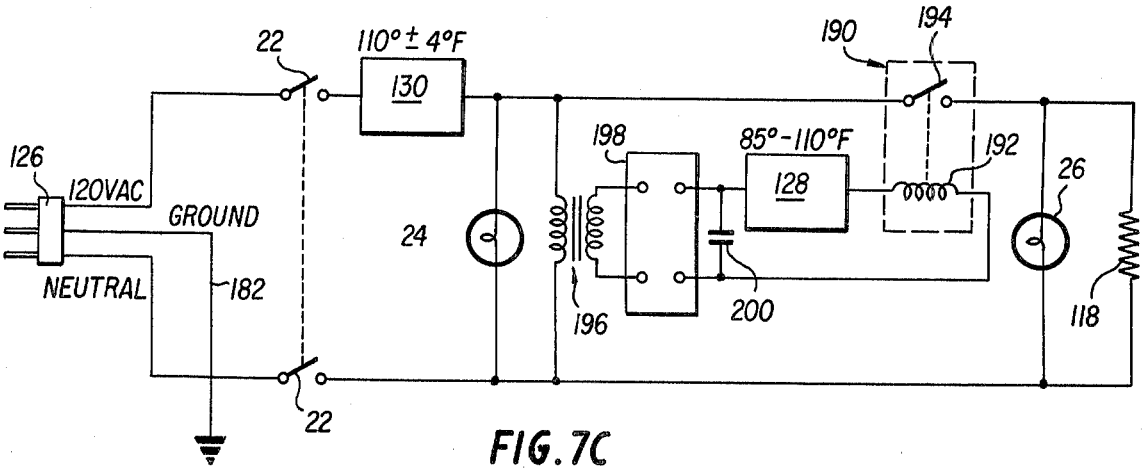
FIG. 7C is a further modified electrical schematic diagram for the warm water supply unit of FIG. 5.

A further modified version of the electrical schematic diagram of FIG. 7A is shown in FIG. 7C. In this case the coil 192 of a normally-open relay 190 operates on 12 volts D.C., which is supplied through the contacts of primary adjustable thermostat 128 by a power supply circuit comprising transformer 196, diode bridge rectifier 198, and filter capacitor 200. The contacts 194 of the D.C relay 190 supply 120-volt A.C. current to the immersion heater 118 in the same manner as in FIG. 7B. The advantage of the arrangement shown in FIG. 7C, however, is that the contact points of the primary adjustable thermostat are only required to switch 12 volts D.C., rather than 120 volts A.C., thereby eliminating an arcing problem that may occur in the circuits of FIGS. 7A and 7B. Preferably, the D.C. relay 190 of FIG. 7C is of the solid-state type, such as the Model D1210 unit manufactured by International Rectifier/Crydom Division of El Segundo, California, which is rated for 10 amperes at 100–140 volts A.C. The transformer 196 may be a Model P-8390 control transformer manufactured by Stancor, Incorporated of Chicago, Illinois, which has a 117-volt A.C. primary coil and a 12-volt secondary coil rated at 0.150 RMS amperes. The rectifier 198 may be a Model S7006 unit manufactured by ST-Semicon, Incorporated, or an International Rectifier Model 1KAB10 unit. Capacitor 200 may be a Model NLW10-16 component manufactured by Cornell-Dubilier, with a capacitance value of 10 MFD.

Although the manner in which the bidet apparatus of the present invention is used will be apparent from the foregoing description, a brief summary of its operation with reference to the drawing figures will be given here for convenience. Once the bidet attachment 12 and warm water supply unit 14 have been initially installed and connected in the manner described previously, the control valve 104 is opened until the storage vessel in the supply unit 14 has filled. This condition will be indicated by the emergence of water from the spray nozzle 38 of the bidet tube. The control valve 104 is then closed and the toggle switch 22 of the unit 14 placed in the "on " position to prepare the unit for use. Initially, the indicator lights 24 and 26 will both be illuminated, indicating that the water in the storage vessel 114 is being heated up to the selected operating temperature. When the red indicator light 26 goes out, the stored water has reached operating temperature and the apparatus is ready for use. With the user now seated on the toilet seat 34, the control valve 104 on the warm water supply unit 14 is opened and the handle portion 30 of the bidet tube is used to bring the spray arm 28 from its storage position to a selected use position. Since a small quantity of cool water will emerge from the spray head 38 before the warm water reaches the bidet attachment, it may be preferable to open the control valve 104 a short time before pivoting the spray arm 28 to the use position, thereby allowing the cooler water to discharge directly into the toilet bowl.

More precise adjustments in the position of the spray nozzle 38 may now be made by virtue of the handle 30 adjustable bidet tube support assembly 42 as described earlier. If desired, the handle 30 may be pivoted or moved back and forth while the bidet is in use in order to cleanse a larger area of the body or to provide an agitated rinsing action. As warm water is discharged from the spray nozzle 38, the storage vessel 114 in the supply unit 14 simultaneously refills with cold water from the cold water supply line, causing the internal immersion heater 118 and red indicator light 26 to be automatically turned on by the primary adjustable thermostat 128. When the user has finished using the bidet attachment 12, the control valve 104 is closed and the spray arm 28 is restored to its storage position. Heating of the water in the storage vessel 114 of the supply unit 14 will continue until the water reaches operating temperature, at which time the red indicator light will again be extinguished, signaling that the unit 14 is ready for another use. It is possible, of course, to use the bidet apparatus before the red light goes out, although this will result in water being discharged from the spray head 38 at a temperature somewhat lower than the desired operating temperature.

Although the present invention has been described with reference to a preferred embodiment, it will be understood that the invention is not limited to the details thereof. Many substitutions and modifications, a few of which have been noted in the foregoing detailed description, may be made without departing from the spirit and scope of the invention as defined in the appended claims.

What is claimed is:

1. A bidet apparatus for use in connection with a conventional flush toilet having a seat with a central opening therein, comprising:

(a) a rigid bidet tube having a bent handle portion at one end thereof, an arcuate spray arm portion and attached spray nozzle at the opposite end thereof, and an intermediate straight portion between said handle portion and said arcuate spray arm; and, (b) a supporting means, attachable to the underside of the toilet seat, for supporting the intermediate straight portion of said bidet tube in a manner permitting said spray arm to be pivoted independently about a first axis common with the axis of said intermediate straight portion, and about a second axis which is perpendicular to said first axis and passes through said supporting means, so that said spray arm portion can be pivoted about said axes from a storage position beneath the rear part of the toilet seat to a use position below the opening in the toilet seat, and said supporting means (i) is arranged with an outer ring fixedly attached to the underside of the toilet seat, and (ii) has an inner cylindrical disc with a flange portion on one end thereof and a lateral bore for rotatably receiving the intermediate straight portion of the the bidet arm, said disc being rotatably received within the outer ring in a manner such that the flange portion of said disc is retained between said outer ring and the underside of the toilet seat.

2. A bidet apparatus as defined in claim 1, wherein the inner cylindrical disc further includes an axial bore communicating with said lateral bore, and wherein a compressed spring is retained in said axial bore between the intermediate portion of the bidet tube and the underside of the toilet seat, said compressed spring thereby providing frictional resistance to the rotation of the spray arm about said first and second axes in order to provide a locking-in-place function for said spray arm.

3. A bidet apparatus as defined in claim 2, further comprising:

(a) a source of warm water for said bidet tube, and (b) a length of flexible tubing for connecting said supply of warm water to the handle portion of said bidet tube.

4. A bidet apparatus as defined in claim 1, wherein a warm water supply unit for use in connection with said bidet tube comprises:

(a) an elongated vertical water storage vessel having an inflow connection at the bottom thereof and an outflow connection at the top thereof, (b) means for heating the water in said vessel, (c) a cold water supply line for supplying pressurized cold water to said inflow connection, (d) a water control valve interposed in said cold water supply line for controlling the flow of water to said inflow connection, and (e) a warm water supply line connected to the outflow connection of said storage vessel for supplying warm water to the bidet attachment when said control valve is opened to admit pressurized cold water to the inflow connection of said storage vessel.

* * * * *